US009400473B1

(12) United States Patent
Stevenson

(10) Patent No.: US 9,400,473 B1
(45) Date of Patent: Jul. 26, 2016

(54) VARIABLE CAPACITY PAPER TRAY

(71) Applicant: Xerox Corporation, Norwalk, CT (US)

(72) Inventor: Duncan I. Stevenson, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/805,101

(22) Filed: Jul. 21, 2015

(51) Int. Cl.
*G03G 15/00* (2006.01)

(52) U.S. Cl.
CPC ..... *G03G 15/6511* (2013.01)

(58) Field of Classification Search
CPC ..... G03G 15/6511
USPC ..... 101/393
See application file for complete search history.

(56) References Cited

U.S. PATENT DOCUMENTS 5,081,595 A 1/1992 Moreno et al.
5,594,541 A 1/1997 Bonislawski, Jr. et al.
6,049,391 A 4/2000 Farrell
6,308,036 B1 10/2001 Taniyama et al.
6,801,742 B1 * 10/2004 Mochimaru ..... G03G 15/1605 399/124
7,917,077 B2 3/2011 Shimizu et al.
8,095,061 B2 1/2012 Fujii
8,385,771 B2 * 2/2013 Mori ..... G03G 15/0131 399/101
2007/0194517 A1 8/2007 Nose et al.
2010/0067964 A1 * 3/2010 Yuyama ..... G03G 21/12 399/358
2014/0010579 A1 * 1/2014 Yoshino ..... G03G 21/105 399/358

* cited by examiner

*Primary Examiner* — Anthony Nguyen
(74) *Attorney, Agent, or Firm* — Gibb & Riley, LLC

(57) ABSTRACT

A media supply device includes a tray feeding printable media into a printing device. The tray has a first section sized for a first size of printable media and a second section sized for a second size of printable media. The first section is within the second section. The tray has a base with a first end and a second end. A first endwall is perpendicularly connected to the first end of the base. A second endwall is perpendicularly connected to the second end of the base. Sidewalls having a top edge are connected to edges of the base between the first endwall and the second endwall. The top edge of the sidewalls is a first height above the base in the first section and a second height above the base in the second section. The first and second heights are different.

19 Claims, 8 Drawing Sheets

VARIABLE CAPACITY PAPER TRAY

BACKGROUND

Devices and methods herein generally relate to multifunction machines having print engines and, more particularly, to paper tray devices in which printable media is placed to be fed into the multifunction machine.

In conventional image forming apparatuses such as copiers, facsimile machines, and printers, toner that fails to be transferred onto a transfer sheet is removed and conveyed into a waste-toner container. The waste system takes up space within the image forming apparatus. In such an image forming apparatus using color, the waste system is significantly larger than the waste system for an apparatus using only black and white. In order to fit the waste-toner container within the image forming apparatus the number and/or capacity of paper trays must be reduced or the ability to employ large size media must be eliminated.

SUMMARY

In one aspect of a device disclosed herein, a printing device may have a paper tray with capacity for a whole ream of 8.5×11 or A4 size media or half-a-ream of 8.5×14 or 11×17 media. The paper tray has an 'L' shape that enables the tray to fit around the waste system and provides the ability to accommodate maximum capacity and maximum number of oversize media pick-points.

According to a media supply device, a tray feeding printable media into a media transportation path of a printing device has a first section and a second section. The first section is sized for a first size of printable media and the second section is sized for a second size of printable media. The first section is within the second section. The tray further includes a base having a first end and a second end. A first endwall is connected to the first end. The first endwall is perpendicular to the base. A second endwall is connected to the second end. The second endwall is perpendicular to the base. The tray also includes sidewalls connected to lateral edges of the base between the first endwall and the second endwall. The sidewalls are perpendicular to the base and have a top edge. The space between the base and the top edge of the sidewalls in the first section is a first height and the space between the base and the top edge of the sidewalls in the second section is a second height. The first height is different from the second height.

According to a printer herein, an imaging apparatus records an image. An image transfer device transfers the image onto a sheet of printable media. A tray feeds the printable media into a media transportation path of the imaging apparatus. The tray comprises a first section and a second section. The first section is sized for a first size of printable media. The second section is sized for a second size of printable media. The first section is within the second section. A toner supply device supplies toner to the image transfer device. A toner removing device removes remaining toner from the image transfer device after the image is transferred to the sheet of printable media. A waste toner container accumulates waste toner removed by the toner removing device. The tray further includes a base having a first end and a second end. A first endwall is connected to the first end. The first endwall is perpendicular to the base. A second endwall is connected to the second end. The second endwall is perpendicular to the base. The tray also includes sidewalls connected to lateral edges of the base between the first endwall and the second endwall. The sidewalls are perpendicular to the base and have a top edge. The space between the base and the top edge of the sidewalls in the first section is a first height and the space between the base and the top edge of the sidewalls in the second section is a second height. The first height is different from the second height. The waste toner container extends into a space resulting from the difference between the first height and the second height.

According to an image forming apparatus, a developing device causes a toner to adhere to a latent image on a photosensitive material drum, forming a visible image. A tray feeds printable media into a media transportation path toward the developing device. The tray comprises a first section and a second section. The first section is sized for a first size of printable media. The second section is sized for a second size of printable media. The first section is within the second section. A toner supply device supplies the toner to the developing device. A toner removing device removes remaining toner after the visible image on the photosensitive material drum is transferred to the printable media. A waste toner container accumulates waste toner removed by the toner removing device. The tray further includes a base having a first end and a second end. A first endwall is connected to the first end. The first endwall is perpendicular to the base. A second endwall is connected to the second end. The second endwall is perpendicular to the base. The tray also includes sidewalls connected to lateral edges of the base between the first endwall and the second endwall. The sidewalls are perpendicular to the base and have a top edge. The space between the base and the top edge of the sidewalls in the first section is a first height and the space between the base and the top edge of the sidewalls in the second section is a second height. The first height is different from the second height. The waste toner container extends into a space resulting from the difference between the first height and the second height.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
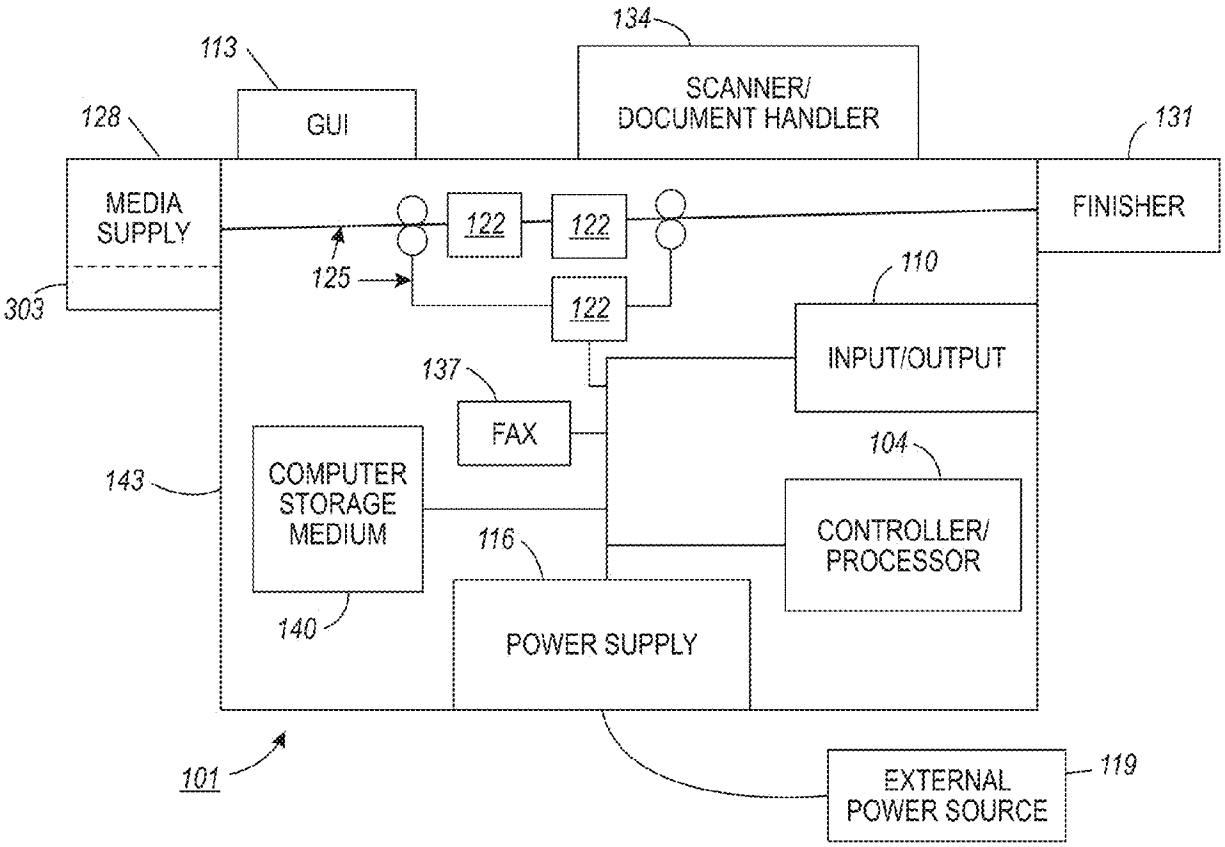
FIG. 1 is an elevational schematic diagram of a multifunction device according to devices and methods herein.

The disclosure will now be described by reference to a printing apparatus that includes a waste toner collection system. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

FIG. 1 illustrates a multifunction device 101 that can be used with devices and methods herein and can comprise, for example, a printer, a copier, a fax machine, etc. The multifunction device 101 includes a controller/processor 104 and an input/output device 110 operatively connected to the controller/processor 104. The controller/processor 104 may be connected to a computerized network external to the multifunction device 101 through a communications port of the input/output device 110. In addition, the multifunction device 101 can include at least one accessory functional component, such as a user interface (GUI) 113. The GUI 113 acts as common interface for job submission and operates on power supplied from a power supply 116. An external power source 119 may provide electrical power to the multifunction device 101 through the power supply 116. The input/output device 110 is used for communications to and from the multifunction device 101. The controller/processor 104 controls the various actions of the multifunction device 101.

The multifunction device 101 may include at least one marking device 122 (sometimes referred to as print engines) operatively connected to the controller/processor 104. A media path 125 is positioned to supply sheets of media from a media supply 128 (that includes a paper tray 303 as described below) to the marking device(s) 122, etc., along the media path 125. After receiving various markings from the printing engine(s), the sheets of media can optionally pass to a finisher 131 which can fold, staple, sort, etc., the various printed sheets.

Further, the marking device 122 is any device capable of rendering an image. The set of marking devices includes digital document reproduction equipment and other copier systems as are widely known in commerce, photographic production and reproduction equipment, monitors and other displays, computer workstations and servers, including a wide variety of color marking devices, and the like.

To render an image is to reduce the image data (or a signal thereof) to viewable form; store the image data to memory or a storage device for subsequent retrieval; or communicate the image data to another device. Such communication may take the form of transmitting a digital signal of the image data over a network.

In addition, the multifunction device 101 can include one or more accessory functional component (such as a scanner/document handler 134, fax module 137, etc.) that also operates on the power supplied from the external power source 119 (through the power supply 116). The fax module 137 may operate in conjunction with the scanner/document handler 134.

The scanner/document handler 134 may be any image input device capable of obtaining information from an image. The set of image input devices is intended to encompass a wide variety of devices such as, for example, digital document devices, computer systems, memory and storage devices, networked platforms such as servers and client devices which can obtain pixel values from a source device, and image capture devices. The set of image capture devices includes scanners, cameras, photography equipment, facsimile machines, photo reproduction equipment, digital printing presses, xerographic devices, and the like. A scanner is one image capture device that optically scans images, print media, and the like, and converts the scanned image into a digitized format. Common scanning devices include variations of the flatbed scanner, generally known in the art, wherein specialized image receptors move beneath a platen and scan the media placed on the platen. Modern digital scanners typically incorporate a charge-coupled device (CCD) or a contact image sensor (CIS) as the image sensing receptor(s). The scanning device produces a signal of the scanned image data. Such a digital signal contains information about pixels such as color value, intensity, and their location within the scanned image.

The multifunction device 101 may also include a non-transitory computer storage medium 140 (which can be optical, magnetic, capacitor based, etc.) is readable by the controller/processor 104 and stores instructions that the controller/processor 104 executes to allow the multifunction device 101 to perform its various functions, such as those described herein.

It should be understood that the controller/processor 104 as used herein comprises a computerized device adapted to perform (i.e., programmed to perform, configured to perform, etc.) the below described system operations. According to devices and methods herein, the controller/processor 104 comprises a programmable, self-contained, dedicated mini-computer. The details of such computerized devices are not discussed herein for purposes of brevity and reader focus.

Thus, as shown in FIG. 1, a device housing 143 has one or more functional components that operate on power supplied from the external power source 119, which may comprise an alternating current (AC) power source, through the power supply 116. The power supply 116 can comprise a power storage element (e.g., a battery) and connects to the external power source 119. The power supply 116 converts the external power into the type of power needed by the various components of the multifunction device 101.

Multifunctional devices, such as shown in FIG. 1, are typically full featured. Various ones of the features provide one or more functions to be performed on a job. For example, a job may include capturing an image at the image input section for storage. The image may undergo a significant amount of image processing allowing for the minimization of image related artifacts and various electronic pages may be edited after the job has been suitably stored. After outputting of the stored job, a host of finishing operations, such as stapling, folding, and trimming may be performed on the hardcopy version of the job to optimize its appearance.

As would be understood by those ordinarily skilled in the art, the multifunction device 101 shown in FIG. 1 is only one example and the devices and methods herein are equally applicable to other types of document handling devices that may include fewer components or more components. For example, while a limited number of printing engines and paper paths are illustrated in FIG. 1, those ordinarily skilled in the art would understand that many more paper paths and additional printing engines could be included within any printing device used with devices and methods herein.

Figure 2:
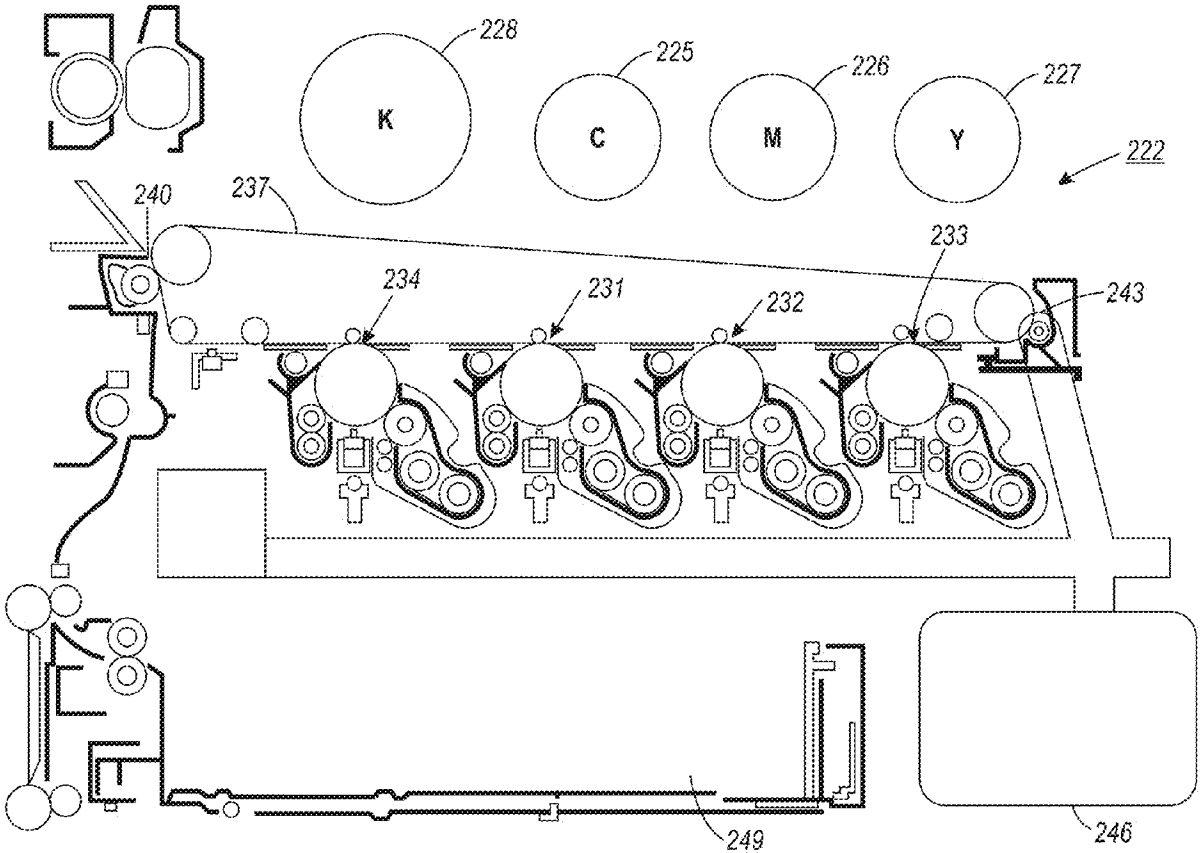
FIG. 2 is a side-view illustration of a common marking device.

FIG. 2 shows a side-view illustration of an image forming apparatus, indicated generally as 222, according to devices and methods herein. The image forming apparatus 222 in the example is enabled for color printing using four color toners: cyan (indicated at 225), magenta (indicated at 226), yellow (indicated at 227), and black (indicated at 228). This is commonly referred to as CMYK. The image forming apparatus 222 includes four image forming units 231, 232, 233, and 234, one for each of the different colors. Each of the image forming units 231, 232, 233, and 234 creates a portion of an image, which is carried by a belt 237 for transferring the image onto a sheet of printable media using a transfer device 240. Toner that fails to be transferred onto the printable media is removed by a toner removal device 243 and conveyed into a waste-toner container 246.

As mentioned above, sheets of printable media are supplied from a media supply 128, such as a paper tray 249 with capacity for a whole ream of 8.5×11 or A4 size media. In order to remove the waste toner, an additional path and an additional driving unit for collecting the waste toner becomes necessary. As a result, the image forming apparatus becomes larger, which affects the size and shape of the paper tray 249. If a full-color image forming apparatus that uses three or four toners recycles the waste toner, a considerably larger waste toner container is required and structure of the full-color image forming apparatus becomes much more complicated.

Figure 3A:
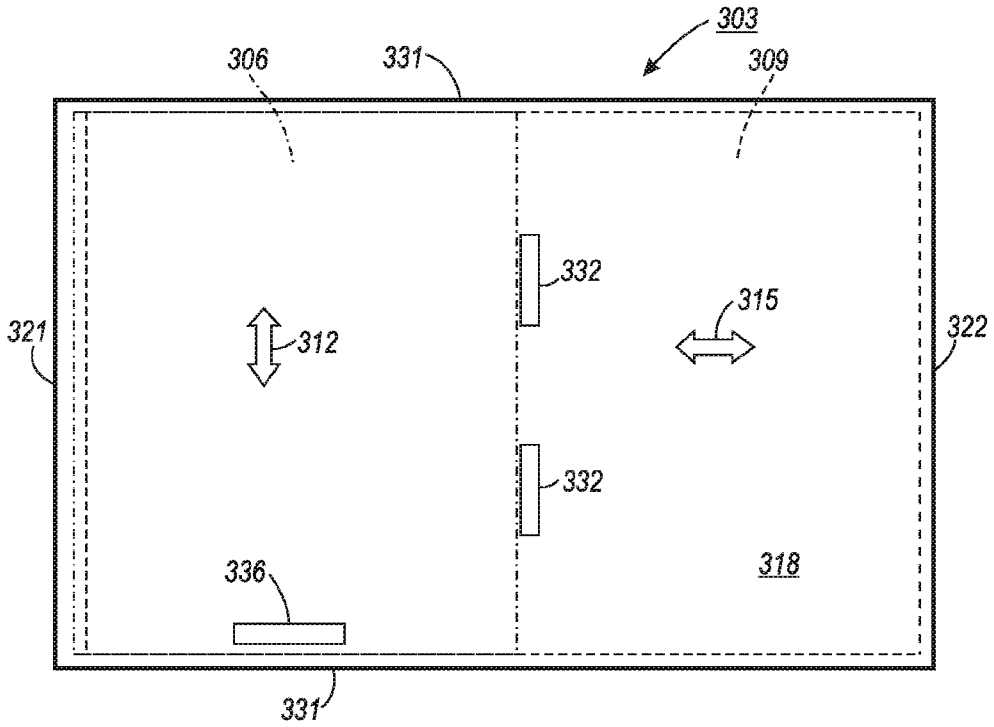
FIGS. 3A-3F illustrate a paper tray according to devices and methods herein.
Figure 3B:
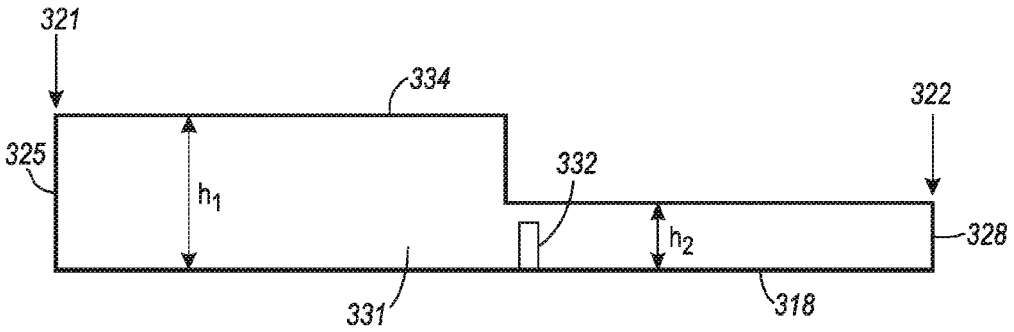

FIGS. 3A and 3B illustrate a paper tray, indicated generally as 303, according to devices and methods herein. FIG. 3A is a plan view of the paper tray 303 and FIG. 3B is a side view of the paper tray 303. Referring to FIG. 3A, the paper tray 303 comprises a first section 306 and a second section 309. The first section 306 is sized for a first size of printable media, which can be in any orientation, such as in a first orientation indicated by arrow 312. For example, the first section 306 may be sized for 8.5×11 or A4 size media. The second section 309 is sized for a second size of printable media, which can be in any orientation, such as in a second orientation indicated by arrow 315. For example, the second section 309 may be sized for 11×17 size media. Notice the first section 306 is within the second section 309.

Referring to FIG. 3B, the paper tray 303 has a base 318 with a first end 321 and a second end 322. A first endwall 325 is connected to the first end 321. The first endwall 325 is substantially perpendicular to the base 318. A second endwall 328 is connected to the second end 322. The second endwall 328 is substantially perpendicular to the base 318, and is parallel to the first endwall 325, but in a different plane. The paper tray 303 also includes sidewalls 331 connected to lateral edges of the base 318 between the first endwall 325 and the second endwall 328. The sidewalls 331 are substantially parallel to one another and perpendicular to the base 318, and have a top edge 334. The space between the base 318 and the top edge 334 of the sidewalls is a first height $h_1$ in the first section 306 and the space between the base 318 and the top edge 334 of the sidewalls is a second height $h_2$ in the second section 309. Notice the first height $h_1$ is different from the second height $h_2$. For example, the second height $h_2$ may be 25%, 40%, 50%, 70%, etc., of the first height $h_1$. The difference in heights allows a first quantity of print media (e.g., a whole ream of 8.5×11 size media) to be loaded in the first section 306 or smaller second quantity (e.g., a half-a-ream of 11×17 size media) to be loaded in the second section 309. The choice of loading the paper tray 303 with 11×17 size media allows an additional oversize pick point for the multifunction device 101. Alternatively, loading the paper tray 303 with 8.5×11 size media allows higher capacity media supply 128. Other sizes and quantities may be used. Additionally, the paper tray 303 may include alignment guides 332 and/or media size sensors 336, which are known in the art.

Figure 3C:
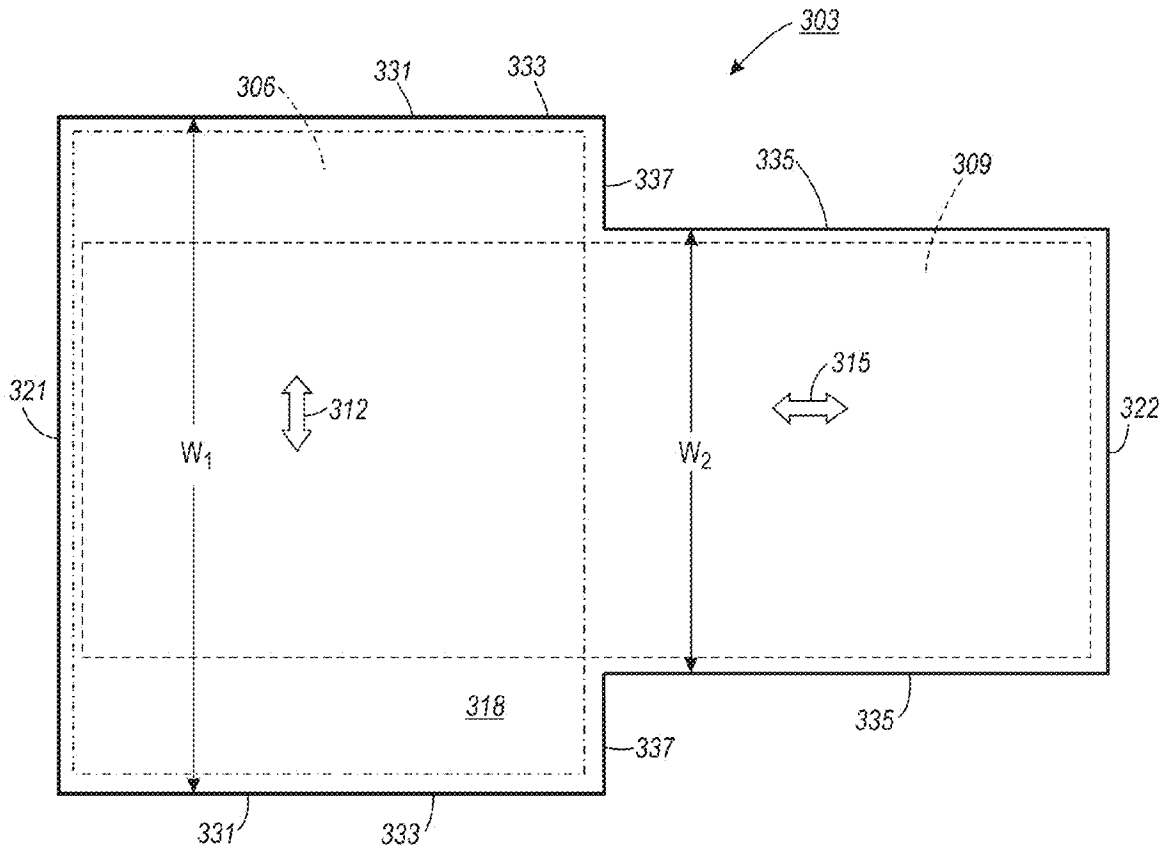

FIG. 3C illustrates a further embodiment that is similar to the foregoing structure, where the same identification numbers represent the same or similar elements. However, in the structure shown in FIG. 3C, the sidewalls 311 include a first sidewall portion 333 and a second sidewall portion 335. Again, the first and second sidewall portions 333, 335 are parallel to each other, and are perpendicular to the base 318 and perpendicular to the first and second endwalls 325, 328. As discussed above, the height ($h_1$) of the first sidewall portion 333 is greater than the height ($h_2$) of the second sidewall portion 335, as shown in FIG. 3B. In addition, connecting sidewall portions 337 are connected to the first and second sidewall portions 333, 335. The connecting sidewall portions 337 both lie in the same plane, which is perpendicular to the first and second sidewall portions 333, 335; and are parallel to the first and second endwalls 325, 328 (but lie in different planes).

In the structure shown in FIG. 3C, the first sidewall portions 333 are spaced further from each other (first width $w_1$) relative to the spacing between the second sidewall portions 355 (second width $w_2$). For example, the second width $w_2$ may be 75%, 80%, 90%, 95%, etc., of the first width $w_1$. With the structure shown in FIG. 3C, if the orientation of the media in the first section 306 is perpendicular to the orientation of the media in the second section 309 (e.g., portrait vs. landscape); while the tray has a lower capacity in the second section 309, the paper tray 303 occupies less space in both the height and width directions relative to a planar rectangular paper tray that does not include the second section 309 with a reduced height.

While FIG. 3C shows that the second width $w_2$ of the paper tray 303 is less than the first width $w_1$, as shown in FIG. 3A, the second width $w_2$ can be the same as the first width $w_1$. For example, 8.5×11 size media and 11×17 size media could both utilize an 11-inch width with the media in different orientations. (See FIGS. 3D and 3E, below.) However, in all cases, the first height $h_1$ of the sidewalls 331 is different from the second height $h_2$, in the first and second section 306, 309.

Figure 3D:
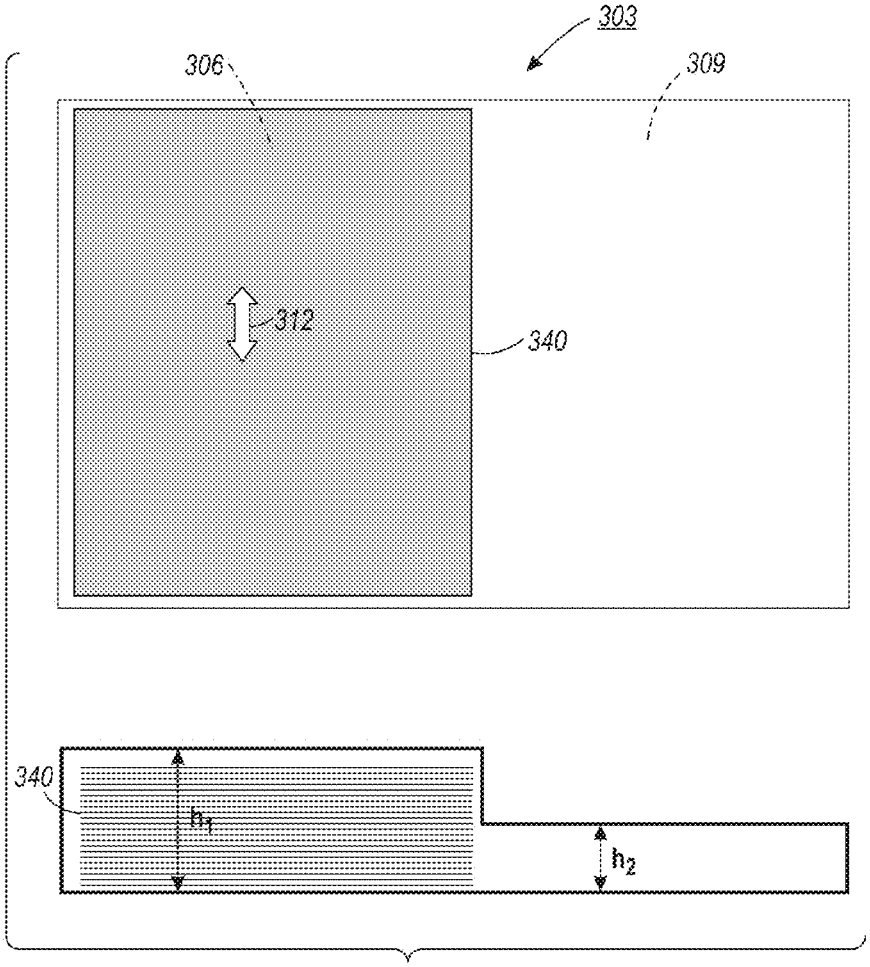
Figure 3E:
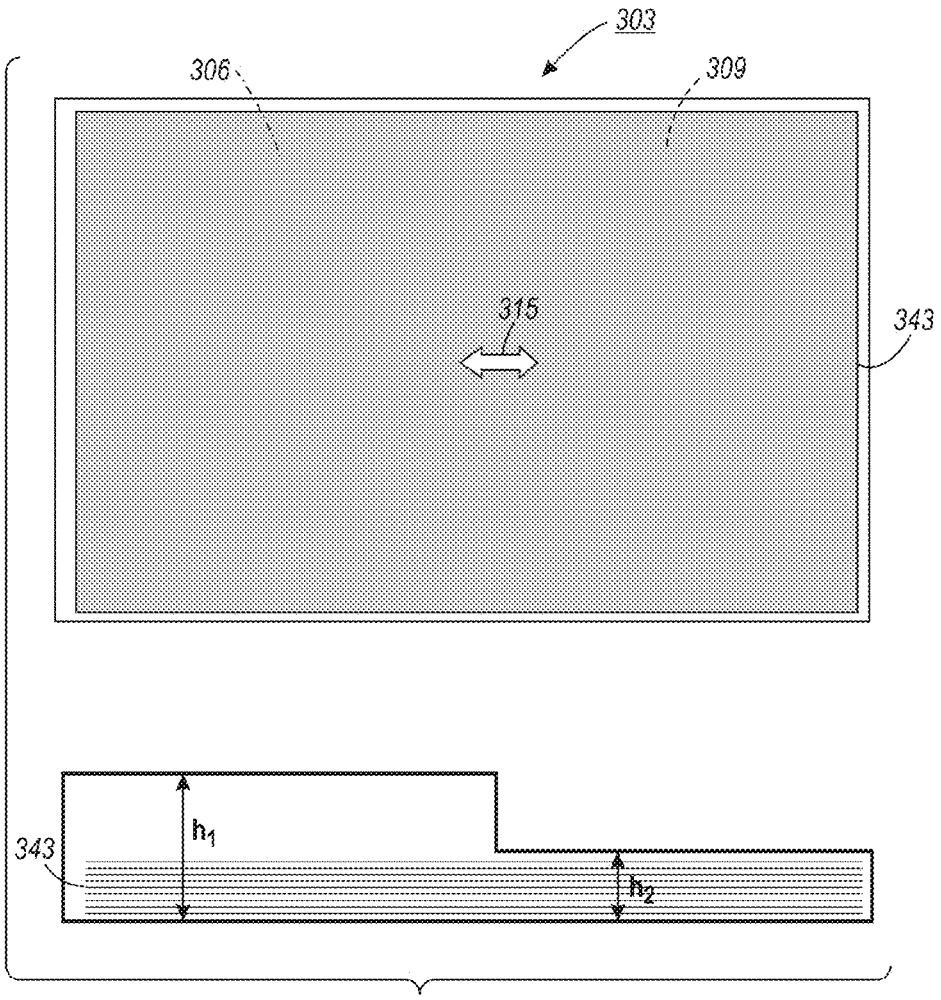
Figure 3F:
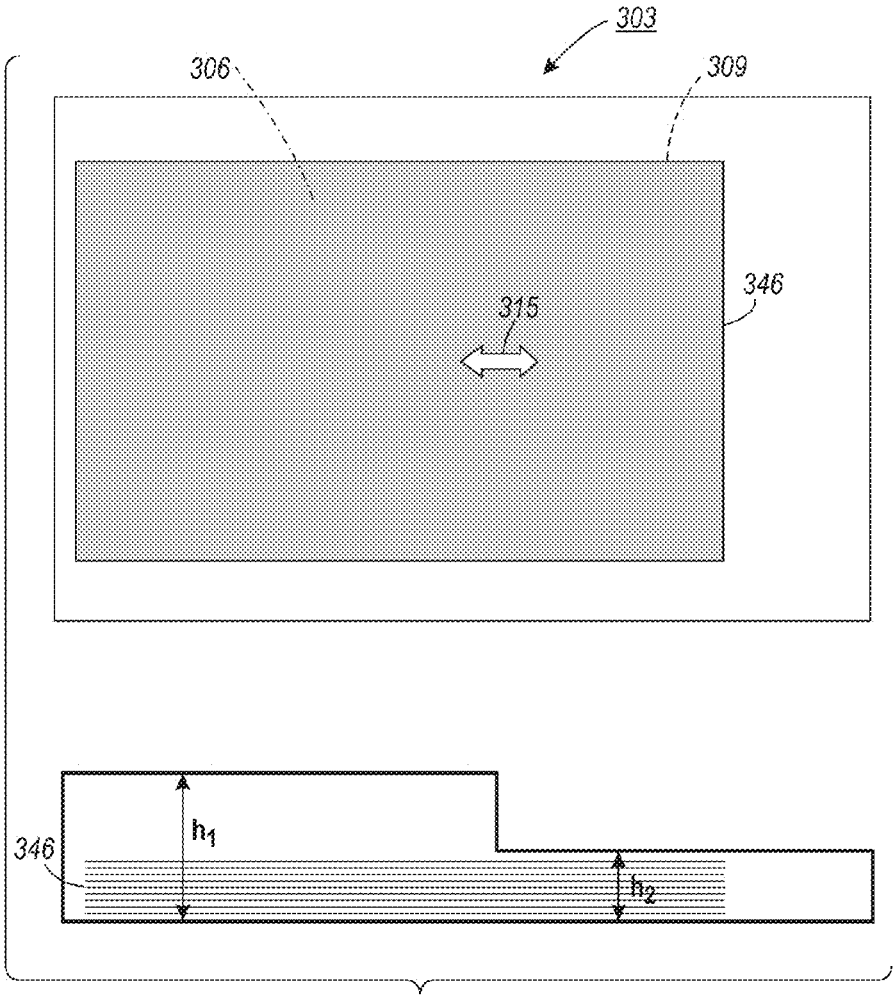

FIG. 3D shows a paper tray 303 according to devices and methods herein containing a stack of 8.5×11 paper 340 in the first section 306. The stack of 8.5×11 paper 340 in FIG. 3D may be a full ream of paper. Notice, the stack of 8.5×11 paper 340 is in the first orientation indicated by arrow 312. FIG. 3E shows a paper tray 303 according to devices and methods herein containing a stack of 11×17 paper 343 in the second section 309. The stack of 11×17 paper 343 in FIG. 3E may be half a ream of paper. Notice the stack of 11×17 paper 343 is in the second orientation indicated by arrow 315. FIG. 3F shows a paper tray 303 according to devices and methods herein containing a stack of 8.5×14 paper 346 in the second section 309. The stack of 8.5×14 paper 346 in FIG. 3F may be half a ream of paper. Notice the stack of 8.5×14 paper 346 is in the second orientation indicated by arrow 315.

Figure 4:
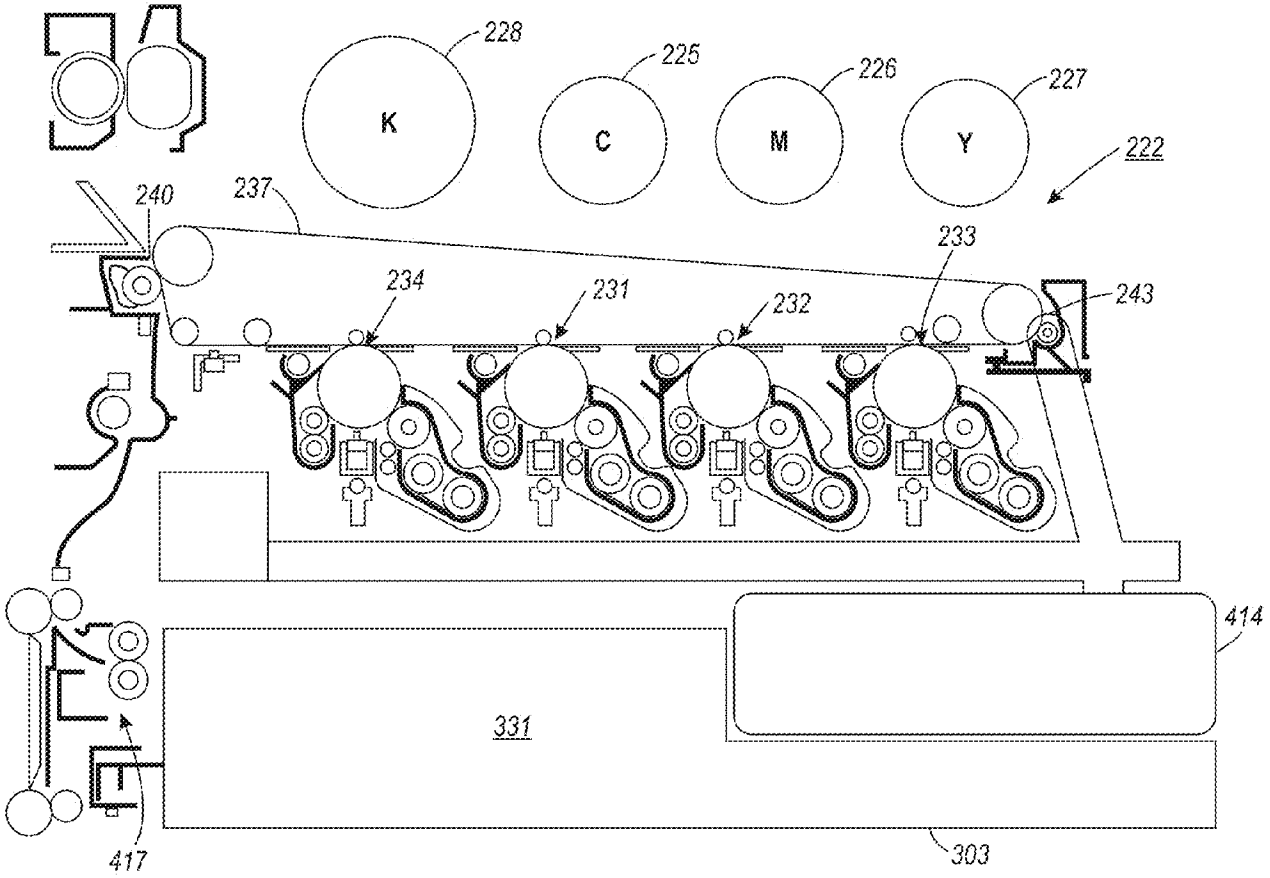
FIG. 4 is a side-view illustration of a marking device according to devices and methods herein.

As shown in FIG. 4, the waste toner container 414 extends into the space resulting from the difference between the first height $h_1$ and the second height $h_2$. That is, the shape of the paper tray 303 enables the paper tray 303 to fit around the waste toner container 414. Additionally, the geometry of the waste toner container 414 prevents incorrect loading of media into the paper tray 303. The device 417 picking printable media from the paper tray 303 would be identical regardless of the size of the printable media.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, it is not intended for the claims presented below to be limited by the attached drawings, but instead the attached drawings are merely provided to illustrate a few ways in which the claimed features can be implemented.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

The terms printer or printing device as used herein encompasses any apparatus, such as a digital copier, bookmaking machine, facsimile machine, multifunction machine, etc., which performs a print outputting function for any purpose. The details of printers, printing engines, etc., are well known by those ordinarily skilled in the art and are not described in detail herein to keep this disclosure focused on the salient features presented. The devices and methods herein can encompass devices that print in color, monochrome, or handle both color and monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises," "comprising," and/or "including," when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user), one or more machines perform the process without further input from any user.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the devices and methods herein should not be implied or imported from any above example as limitations to any particular order, number, position, size, shape, angle, color, or material.

What is claimed is:

1. A media supply device comprising:

a tray feeding printable media into a media transportation path of a printing device, said tray comprising a first section and a second section, said first section being sized for a first size of printable media, and said second section being sized for a second size of printable media, said first section being within said second section;

said tray further comprising:

a base having a first end and a second end, a first endwall connected to said first end, said first endwall being perpendicular to said base, a second endwall connected to said second end, said second endwall being perpendicular to said base, and sidewalls connected to lateral edges of said base between said first endwall and said second endwall, said sidewalls being perpendicular to said base and having a top edge, the space between said base and said top edge of said sidewalls in said first section being a first height and the space between said base and said top edge of said sidewalls in said second section being a second height, said first height being different from said second height, said sidewalls being sized and configured to fit around a waste toner container of said printing device.

2. The media supply device according to claim 1, further comprising:

a media size sensor attached to said tray determining a size of said printable media.

3. The media supply device according to claim 1, further comprising:

a device picking printable media from said tray and feeding said printable media into said media transportation path of said printing device.

4. The media supply device according to claim 1, said printing device further comprising an image transfer device transferring an image onto a sheet of printable media.

5. The media supply device according to claim 4, said image transfer device further comprising:

a toner supply device supplying toner to said image transfer device;

a toner removing device removing remaining toner from said image transfer device after said image is transferred to said sheet of printable media; and a waste toner container accumulating waste toner removed by said toner removing device.

6. The media supply device according to claim 5, said waste toner container extending into a space resulting from the difference between said first height and said second height.

7. A printer, comprising:

an imaging apparatus recording an image;

an image transfer device transferring said image onto a sheet of printable media; and a tray feeding said printable media into a media transportation path of said imaging apparatus, said tray comprising a first section and a second section, said first section being sized for a first size of printable media, and said second section being sized for a second size of printable media, said first section being within said second section, said image transfer device further comprising:

a toner supply device supplying toner to said image transfer device;

a toner removing device removing remaining toner from said image transfer device after said image is transferred to said sheet of printable media; and a waste toner container accumulating waste toner removed by said toner removing device, said tray further comprising:

a base having a first end and a second end, a first endwall connected to said first end, said first endwall being perpendicular to said base, a second endwall connected to said second end, said second endwall being perpendicular to said base, and sidewalls connected to lateral edges of said base between said first endwall and said second endwall, said sidewalls being perpendicular to said base and having a top edge, the space between said base and said top edge of said sidewalls in said first section being a first height and the space between said base and said top edge of said sidewalls in said second section being a second height, said first height being different from said second height, said waste toner container extending into a space resulting from the difference between said first height and said second height.

8. The printer according to claim 7, said tray further comprising:

a media size sensor attached to said tray determining a size of said printable media.

9. The printer according to claim 7, said tray further comprising:

a device picking printable media from said tray and feeding said printable media into said media transportation path of said imaging apparatus.

10. The printer according to claim 7, said sidewalls being sized and configured to fit around said waste toner container.

11. The printer according to claim 7, said toner supply device supplying color toner comprising CMYK.

12. The printer according to claim 7, said first size of said printable media comprising one of 8.5×11 and A4 size media.

13. The printer according to claim 7, said second size of said printable media comprising 11×17 size media.

14. An image forming apparatus, comprising:

a developing device causing a toner to adhere to a latent image on a photosensitive material drum, to form a visible image;

a tray feeding printable media into a media transportation path toward said developing device, said tray comprising a first section and a second section, said first section being sized for a first size of printable media, and said second section being sized for a second size of printable media, said first section being within said second section;

a toner supply device supplying said toner to said developing device;

a toner removing device removing remaining toner after said visible image on said photosensitive material drum is transferred to said printable media; and a waste toner container accumulating waste toner removed by said toner removing device, said tray further comprising:

a base having a first end and a second end, a first endwall connected to said first end, said first endwall being perpendicular to said base, a second endwall connected to said second end, said second endwall being perpendicular to said base, and sidewalls connected to lateral edges of said base between said first endwall and said second endwall, said sidewalls being perpendicular to said base and having a top edge, the space between said base and said top edge of said sidewalls in said first section being a first height and the space between said base and said top edge of said sidewalls in said second section being a second height, said first height being different from said second height, said waste toner container extending into a space resulting from the difference between said first height and said second height.

15. The image forming apparatus according to claim 14, said tray further comprising:

a media size sensor attached to said tray determining a size of said printable media.

16. The image forming apparatus according to claim 14, said tray further comprising:

a device picking printable media from said tray and feeding said printable media into said media transportation path of said developing device.

17. The image forming apparatus according to claim 14, said sidewalls being sized and configured to fit around said waste toner container.

18. The image forming apparatus according to claim 14, said toner supply device supplying color toner comprising CMYK.

19. The image forming apparatus according to claim 14, said first size of said printable media comprising one of 8.5×11 and A4 size media, and said second size of said printable media comprising 11×17 size media.

* * * * *